US005108312A

United States Patent [19]

Sampson

[11] Patent Number: 5,108,312

[45] Date of Patent: Apr. 28, 1992

[54] SNAP EYELET FOR MOUNTING AND GROUNDING AN ELECTRICAL CONNECTOR TO A CIRCUIT BOARD

[75] Inventor: Stephen A. Sampson, Downers Grove, Ill.

[73] Assignee: Molex Incorporated, Lisle, Ill.

[21] Appl. No.: 686,072

[22] Filed: Apr. 15, 1991

[51] Int. Cl.[5] ..... H01R 13/652

[52] U.S. Cl. ..... 439/607; 439/95; 439/567

[58] Field of Search ..... 439/557, 567, 607, 92, 439/95, 83, 552

[56] References Cited

U.S. PATENT DOCUMENTS 4,679,883 7/1987 Assini et al. .
4,824,398 4/1989 Taylor ..... 439/557
4,842,552 6/1989 Frantz .
4,865,555 9/1989 Assini et al. .

*Primary Examiner*—Eugene F. Desmond

*Attorney, Agent, or Firm*—A. A. Tirva; Charles S. Cohen; Stephen Z. Weiss

[57] ABSTRACT

A snap eyelet is provided for securely mounting an electrical connector housing to a circuit board and for completing electrical connection between a conductive shield on the housing and a ground circuit on the circuit board. The snap eyelet is constructed to avoid an initial deflection of the board engaging structure during mounting onto the electrical connector housing. In particular, the snap eyelet includes a cylindrical shank dimensioned to be slidably inserted upwardly into a mounting aperture of the connector housing. The bottom end of the shank include flanges which engage a bottom surface of the connector housing when the shank is inserted upwardly into the mounting aperture of the housing. The top end of the shank is provided with tabs that are deflectable into engagement with the top surface of the connector housing for securely engaging the shank therein. Deflectable board engaging beams extend from the bottom of the shank and are dimensioned to snap into engagement with the circuit board adjacent an aperture therein.

13 Claims, 2 Drawing Sheets

FIG.3
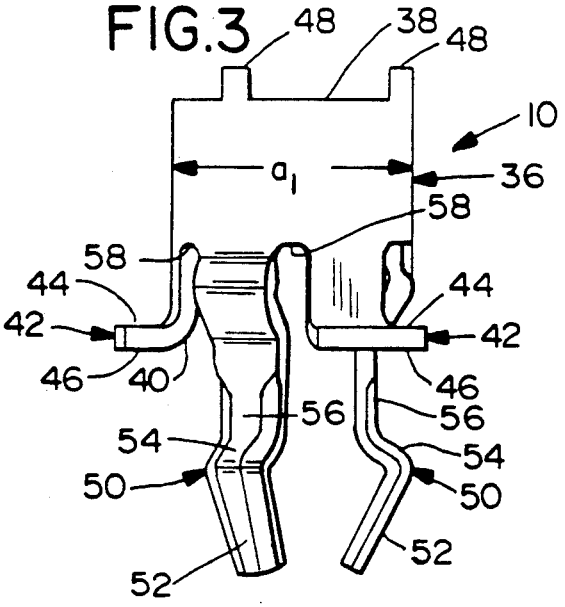
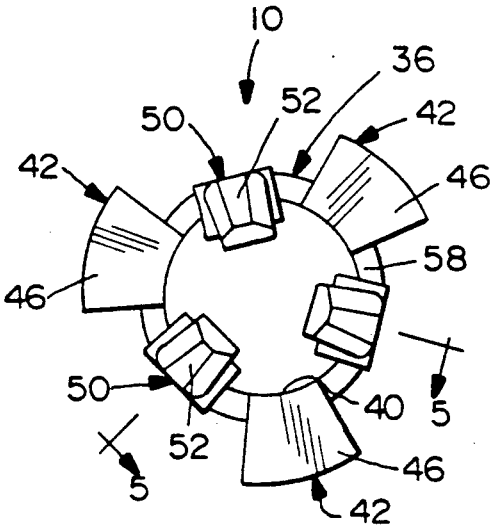
FIG.4
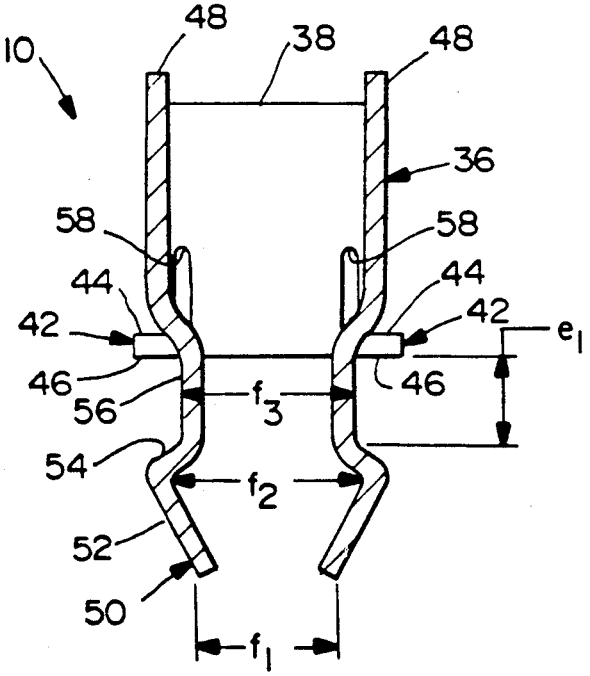
FIG.5
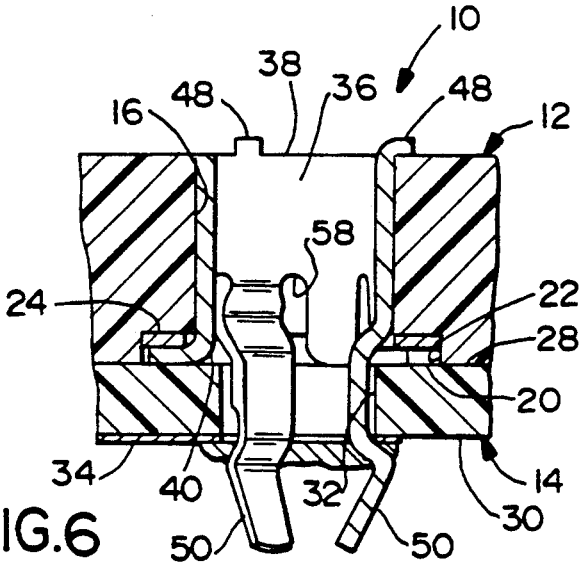
FIG.6

SNAP EYELET FOR MOUNTING AND GROUNDING AN ELECTRICAL CONNECTOR TO A CIRCUIT BOARD

BACKGROUND OF THE INVENTION

Board-mounted electrical connectors comprise a molded non-conductive housing having electrically conductive terminals therein. The housing includes a board mounting face for mounting on a circuit board and a mating face for mating with another connector. The mating face typically is either parallel to the board mounting face or orthogonal thereto. Each terminal in the prior art connector includes a mating end disposed in proximity to the mating face of the housing for achieving electrical connection with a corresponding terminal in a housing mated therewith. Each terminal further includes a board mounting end which extends beyond the board mounting face of the connector for soldered electrical connection to circuitry printed or otherwise disposed on the board.

The housing of the prior art electrical connector must be securely retained on the circuit board prior to soldering of the electrical connections to the board. A connector that is insecurely mounted to the circuit board prior to soldering of the electrical connections may move in response to forces generated during component assembly and soldering operations and may result in improper alignment of the connector with the board. Improper alignment could preclude matability with the connector. Additionally, even after soldering excessive forces generated by the mating and unmating of the improperly positioned connectors may cause movement between the connector and the board. Any such movement between the connector and the circuit board can damage the soldered electrical connections between the terminals and the circuitry on the board. To prevent such movement, the prior art connectors are provided with separate board mounting means which typically are defined by deflectable latches dimensioned and disposed to pass through apertures in the circuit board and to engage regions of the circuit board adjacent to the aperture. In many prior art connectors the board mounting latches are made of plastic and are unitarily molded as part of the electrical connector housing. Each such latch will extend beyond the board mounting face of the electrical connector housing, and will include a ramped leading face to generate deflection during mounting on the circuit board and a locking shoulder for engaging the surface of the circuit board opposite connector. Unitarily molded plastic board mounting latches are widely employed and generally function well. The resiliency inherent in the plastic enables these prior art board mounting means to be deflected several times. However, small plastic board mounting latches may not provide adequate strength for some applications, and can break in response to some applied forces.

Electrical connectors employed in telecommunications equipment, computers and other such devices are subject to generating or picking up radio frequency or electromagnetic interference. Interference of this type can degrade the quality of the signal being carried by the electrical connector or can affect the performance of adjacent connectors. To prevent such interference, many connectors employed in telecommunications equipment and in computers are provided with conductive shielding that is electrically connected to a ground circuit on the circuit board. Some prior art electrical connectors have incorporated the shield and grounding structures of the connector with the board mounting structures. In particular, metallic board mounting means may be employed in place of the above described plastic latches. The metallic board mounting latches may be electrically connected to the shield on the connector and may further be electrically connected to the ground circuit on the circuit board. Metallic board mounting latches can also be engineered to provide exceptional strength, and are less likely to break than plastic latches when subjected to higher then normal forces during mounting of the connector on to the circuit board. In this regard, higher than normal forces may be encountered in situations where the mounting apertures in the circuit board are imprecisely dimensioned or located.

Although metallic board mounting latches provide many advantages as compared to plastic latches, the metallic board mounting structures may exhibit less resiliency than their plastic counterparts. In particular, a plastic latch will tend to return to its initial position after several deflections while the small metallic latches may permanently deform after its first deflection.

One prior art metallic means for mounting an electrical connector to a circuit board is shown in U.S. Pat. No. 4,842,552 which issued to Frantz on Jun. 27, 1989. The mounting member shown in U.S. Pat. No. 4,842,552 includes a formed rectangular body having a pair of opposed flanges extending upwardly and outwardly therefrom for engaging a top surface of the connector and two opposed pairs of locking legs extending downwardly from the body. The legs are configured and dimensioned to pass through a mounting aperture in the electrical connector. The legs will then further extend downwardly through a mounting aperture in the circuit board. Each pair of legs are of slightly different lengths to accommodate variations in board thickness. Thus, depending upon the thickness of the circuit board two legs of the board lock are intended to engage the lower surface of the circuit board. The board lock configuration shown in U.S. Pat. No. 4,842,552 inherently requires a first deflection of all legs as the legs are passed through the mounting aperture in the electrical connector and then a second deflection of all legs as the legs are passed through the mounting aperture in the circuit board. As explained above, the deflection caused by the initial downward movement of the board lock through the aperture in the connector can cause a permanent set in the legs that will diminish the ability of the board lock to securely hold the electrical connector on the circuit board. As explained above, a poorly held circuit board can shift in response to mating forces, vibrations or various environmental conditions, with a resulting potential for damage to soldered electrical connections. Similar board locks having deflectable legs that must be urged downwardly through both the electrical connector and the circuit board are shown in U.S. Pat. No. 4,717,219 which issued to Frantz et al on Jan. 5, 1988 and in U.S. Pat. No. 4,865,555 which issued to Assini et al on Sep. 12, 1989.

U.S. Pat. No. 4,824,398 issued to Taylor on Apr. 25, 1989 and shows a stand-off board lock having a pair of generally semi-cylindrical members intended to pass into and partly through a mounting aperture in a circuit board. A cylindrical stand-off extends between the circuit board and the electrical connector. A smaller cylindrical portion extends axially from the end of the standoff opposite the circuit board and is dimensioned to pass through apertures in the connector. The stand-off board lock shown in U.S. Pat. No. 4,824,398 is a machined member having a threaded central aperture extending therethrough. A bolt or screw would be passed through the aperture in the electrical connector for threaded engagement with the array of internal threads on the standoff. The machined stand-off board lock shown in U.S. Pat. No. 4,824,398 would be much more expensive to manufacture then stamped and formed components. In this regard, it must be noted that the electrical connector industry is very competitive and even small savings in material and costs can be significant. The requirement of an additional threaded retention member to engage the stand-off further adds to cost and complicates assembly.

Rivets have also been employed as board locks, as shown in U.S. Pat. No. 4,679,883. The rivets shown in U.S. Pat. No. 4,679,883 include a flange at one end to engage either a surface of the circuit board or a surface of the connector. A cylindrical portion extends from the flange and is dimensioned to extend through and beyond both the connector and the circuit board. The end of the cylindrical portion remote from the flange is subsequently mechanically deformed to retain the connector on the circuit board. The forces required to deform a cylindrical portion of a rivet can be undesirably high and can damage portions of the connector. Additionally, rivets are inherently relatively fixed with respect to the disposition of the holes in the connector. Unfortunately, however, considerable variation is likely in the disposition of the mounting apertures in the circuit board. This can require forcing the rivets into the mounting apertures in the circuit board, thereby damaging the circuit board or imposing undesirable stresses thereon.

In view of the above, it is an object of the subject invention to provide a metallic member for mounting an electrical connector to a circuit board.

It is another object of the subject invention to provide a metallic member for mechanically mounting and electrically grounding a connector to a circuit board.

An additional object of the subject invention is to provide an electrical connector having deflectable board engaging latches that do not require an initial deflection prior to mounting on the circuit board.

Yet another object of the subject invention is to provide a board mounting member which ensures secure connector to board engagement despite variations in locations of the board mounting apertures in the board.

SUMMARY OF THE INVENTION

The subject invention is directed to a snap eyelet for retaining an electrical connector to a circuit board and for electrically connecting the shield of the connector to a ground circuit on the board. A plurality of the snap eyelets of the subject invention may be used to retain the connector to the circuit board. In this regard, the electrical connector may include a plurality of generally cylindrical mounting apertures each of which is dimensioned for receiving a first portion of snap eyelet, while the circuit board may be provided with a corresponding plurality of mounting apertures each of which is dimensioned for receiving a second portion of a snap eyelet.

The snap eyelet of the subject invention is stamped and formed from an initially flat blank of metallic material. More particularly, the snap eyelet may be formed to define a generally cylindrical shank having an outer cross-sectional diameter generally corresponding to the diameter of a mounting aperture in the connector. The shank may have opposed top and bottom axial ends defining a length approximately equal to the thickness of the portion of the connector through which the mounting aperture extends. Thus, the shank of the snap eyelet may be slidably advanced into the mounting aperture of the connector such that substantially all of the shank is disposed therein.

At least one bottom mounting flange extends unitarily outwardly from the bottom end of the cylindrical shank of the snap eyelet, and may be generally orthogonal to the longitudinal axis of the shank. The bottom mounting flange is dimensioned to engage a bottom surface on the connector when the shank of the snap eyelet is slidably inserted into the mounting aperture of the connector. Preferably a plurality of bottom mounting flanges are provided as explained further below.

The snap eyelet may further include at least one deformable engagement tab extending generally axially upwardly from the top end of the cylindrical shank. The top tabs are disposed and dimensioned to extend upwardly beyond the top surface of the connector when the shank of the snap eyelet is slidably inserted upwardly into the mounting aperture of the connector sufficiently for the bottom mounting flanges to engage the bottom surface of the connector. The tabs may then be deformed by bending or folding radially outwardly relative to the longitudinal axis of the shank and into mechanical engagement with a top surface of the electrical connector housing. The force required to bend or fold the top tabs depends upon the circumferential dimension of each tab, and is much lower than the force required for deformation of a cylindrical rivet member.

The snap eyelet of the subject invention further includes a plurality of deflectable board engaging beams extending downwardly beyond the bottom end of the shank and beyond the bottom mounting flanges of the snap eyelet. Each deflectable board engaging beam may be disposed between a pair of the bottom mounting flanges. The extreme lower end of each deflectable board engaging beam may define a ramped surface angularly aligned to the longitudinal axis of the shank for generating inward deflection of the beam during insertion of the beam into the mounting aperture of the board. A locking surface may be disposed on each beam generally adjacent the ramped surface, and may be angularly aligned for engaging the bottom surface of the circuit board after sufficient insertion of the beams through the mounting aperture in the circuit board. A board engaging section is defined along each beam at axial positions between the locking surface and the bottom mounting flanges of the snap eyelet. The board engaging sections are generally parallel to the longitudinal axis of the snap eyelet and will engage interior circumferential surfaces of the board mounting aperture. Each deflectable board engaging beam may be chamfered to prevent sharp edge regions from cutting into portions of the circuit board defining the board mounting aperture. More particularly, the chamfer will ensure that a generally central portion of each deflectable mounting beam will engage an inner circumferential surface portion of the mounting aperture in the circuit board.

The forces required to deflect each board mounting beam will depend, in part, upon the length of the deflectable beam. To facilitate deflection during mounting on the circuit board, the shank of the snap eyelet may be provided with longitudinally extending slots disposed to effectively extend the axial length of each board engaging beam, and thereby making deflection of each beam easier.

The snap eyelet of the subject invention is employed by initially inserting the top end of the shank upwardly through the mounting aperture in the connector until the bottom mounting flanges of the snap eyelet engage the bottom surface of the connector. In this relative position, the top tabs extending from the top end of the shank will project upwardly beyond the top surface of the connector. These tabs may then be deformed by folding outwardly over the top surface of the connector for securely retaining the snap eyelet to the connector. More particularly, the outer cylindrical surface of the shank will frictionally engage the inner cylindrical surface of the mounting aperture in the connector. Additionally, bottom and top surfaces respectively of the connector will be securely retained between the bottom mounting flanges of the snap eyelet and the folded top tabs of the snap eyelet. The connector may then be positioned onto the circuit board such that the solder tails of respective terminals in the connector pass through appropriate apertures in the circuit board, and such that the deflectable beams of the snap eyelet are urged downwardly into the mounting aperture of the circuit board. This downward movement of the connector toward the circuit board will cause the ramped bottom ends of each deflectable beam to engage regions of the circuit board defining the periphery of the mounting aperture therein, and will accordingly generate an inward deflection of each deflectable beam. After sufficient downward movement of the connector relative to the circuit board, however, the locking surface of each deflectable mounting beam will align with the bottom face of the circuit board. As a result, the deflectable mounting beams will resiliently return toward an undeflected condition such that the locking surfaces thereof securely engage the lower face of the circuit board. Simultaneously, the board engaging section of each mounting beam will engage a longitudinally extending portion of the inner cylindrical surface of the mounting aperture in the circuit board.

It will be appreciated that the snap eyelet of the subject invention only requires a single deflection of the deflectable mounting beams during mounting of the connector onto the circuit board. Thus, the deflectable mounting beams of the snap eyelet will not achieve an initial set that will permanently deform the beams from their specified alignment for retaining the connector on the circuit board. Additionally, the retention of the snap eyelet to the connector can be carried out easily with a relatively minor application of force for deforming the top tabs.

BRIEF DESCRIPTION OF THE DRAWINGS

FIG. 3 is a side elevational view of the snap eyelet.

FIG. 4 is a bottom plan view of the snap eyelet.

FIG. 5 is a cross-sectional view taken along line 5—5 in FIG. 4.

FIG. 6 is a cross-sectional View similar to FIG. 2 showing the snap eyelet, the connector and the circuit board in their fully assembled condition.

DETAILED DESCRIPTION OF THE PREFERRED EMBODIMENT

Figure 2:
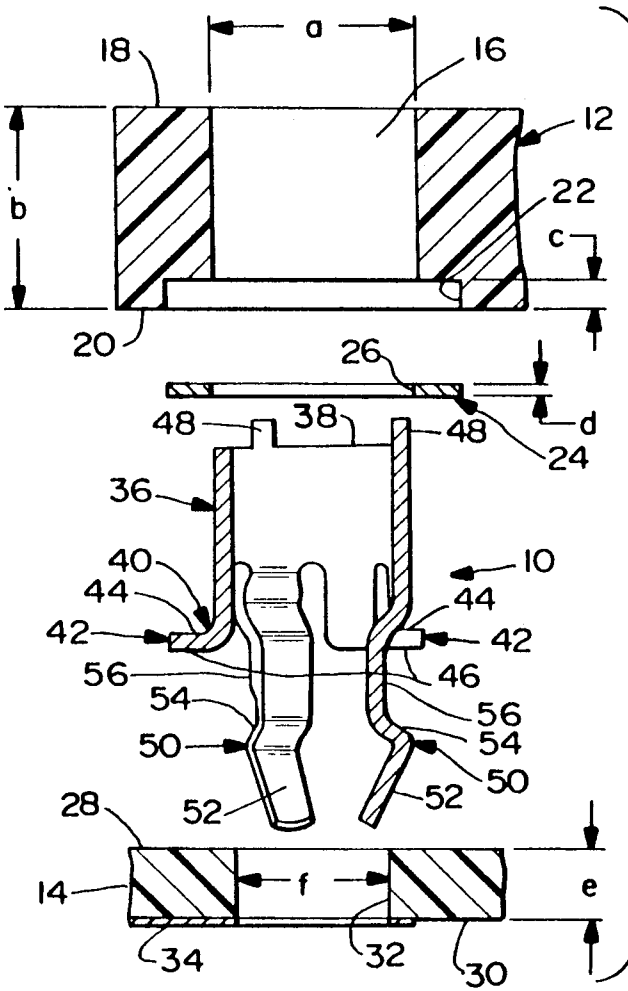
FIG. 2 is a cross-sectional view taken along line 2—2 in FIG. 1.
Figure 1:
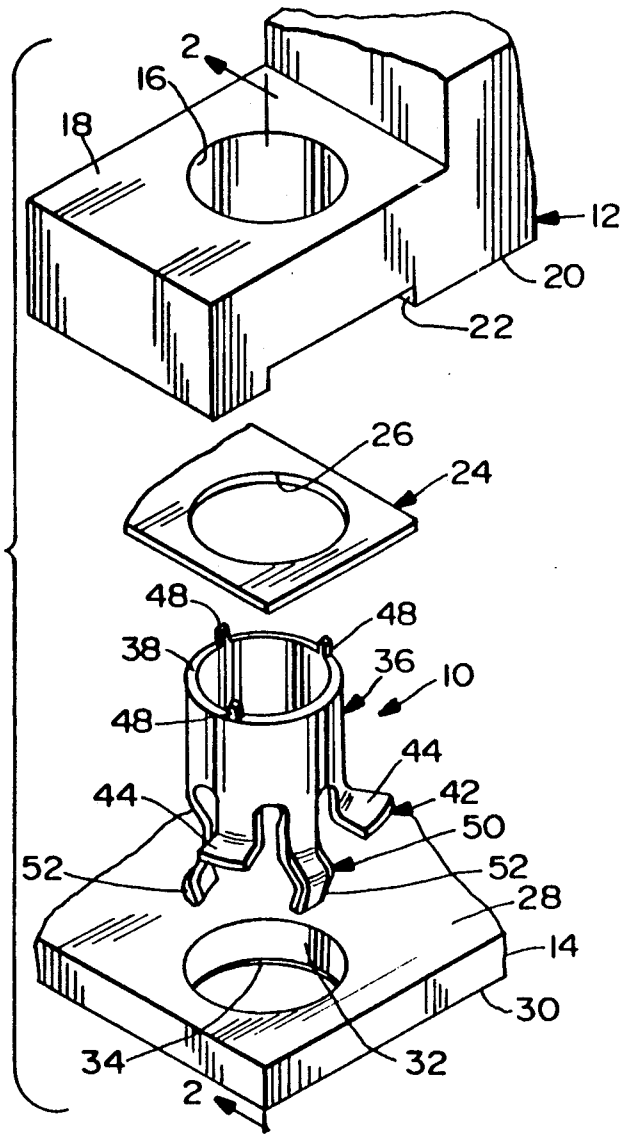
FIG. 1 is an exploded perspective view of a snap eyelet in accordance With the subject invention a connector and a circuit board.

The snap eyelet of the subject invention is identified generally by the numeral 10 in FIGS. 1 through 6. With reference to FIGS 1 and 2, the snap eyelet 10 is used to mount an electrical connector housing 12 to a circuit board 14. The electrical connector housing 12 is formed to include a cylindrical mounting aperture 16 of diameter "a" extending entirely therethrough form a top surface 18 to a bottom surface 20 thereof. The thickness of the electrical connector housing 12 in the vicinity of the mounting aperture 16 is indicated by dimension "b" in FIG. 2. The bottom 20 of the electrical connecting housing 12 is characterized by a recessed portion 22 which surrounds the mounting aperture 16. The recess 22 defines depth "c". The electrical connector housing 12 is characterized by a grounding shield 24, a portion of which is disposed in the recess 22. Other portions (not shown) will extend into locations on the housing 12 for most effectively suppressing radiation and preventing stray radiation from being picked up. The portion of the shield 24 disposed within the recess 22 defines a thickness "d" which is less than the depth "c" of the recess 22. This portion of the shield 24 disposed in the recess 22 is further characterized by an aperture 26 disposed substantially in register with the mounting aperture 16 of the housing 12. It is to be understood that the mounting aperture 16 depicted in FIG. 4 is one of two or more such mounting apertures provided on the electrical connector housing 12.

The circuit board 14 includes a top surface 28 and opposed bottom surface 30 defininq a thickness "e" therebetween. The top surface 28 defines the portion of the circuit board 14 on which the bottom surface 20 of the electrical connector housing 12 will rest. The circuit board 14 is further characterized by a cylindrical mounting aperture 32 of diameter "f" extending therethrough. A ground circuit 34 is printed or otherwise disposed on the bottom surface 30 of the circuit board 14 as shown in FIG 2 and extends to the mounting aperture 32. The snap eyelet 10 will enable the mechanical connection of the housing 12 to the circuit board 14, and also will enable the electrical connection of the shield 24 to the ground circuit 34 as explained further herein.

Turning to FIGS. 3–6, the snap eyelet 10 is stamped and formed from a unitary sheet of conductive material that will exhibit acceptable electrical conductivity, resiliency and strength. In particular, the snap eyelet 10 may be stamped and formed from a 0.33 millimeter thick 260 brass approximately half hard. The brass may be plated with tin and nickel to enhance conductivity and to enhance the soldering that will subsequently be carried out as explained herein.

The snap eyelet 10 is formed to include a generally cylindrical shank 36 having an external diameter "$a_1$" which is approximately equal to the diameter "a" of the mounting aperture 16 in the electrical connector housing 12. Thus, the cylindrical shank 36 can be slidably inserted into the mounting aperture 16 of the electrical connector housing 12 as explained below.

The cylindrical shank 36 includes a top end 38 and an opposed bottom end 40. Three bottom flanges 42 are spaced approximately equally about the circumference of the cylindrical shank 36 at the bottom end 40 thereof. The bottom flanges 42 define a diameter which is substantially greater than the diameter "a" of the mounting aperture 16 in the electrical connector housing 12. However, the diameter defined by the bottom flanges 42 is sufficiently small to enable the bottom flanges to be advanced into the recess 22 in the bottom 20 of the electrical connector housing 12. In view of this construction, the cylindrical shank 36 can be slidably advanced into the mounting aperture 16 of the electrical connector housing 12 from the bottom face 20 thereof toward the top face 18. The bottom flanges 42 will advance into the recess 22 in the bottom face 20 of the electrical connector housing 12, but will prevent continued upward advancement of the cylindrical shank 36 into the mounting aperture 16. The bottom flanges 42 are characterized by top surfaces 44 and opposed bottom surfaces 46 defining a thickness "g" corresponding to the overall thickness of the conductive metal from which the snap eyelet 10 is stamped and formed. The thickness "g" of the bottom flanges 42 plus the thickness "d" of the conductive shield 24 is approximately equal to the depth "c" of the recess 22 formed in the bottom 20 of the electrical connector housing 12. As a result, both the conductive shield 24 and the bottom flanges 42 of the snap eyelet 10 can be disposed in the recess 22, such that the bottom surface 46 of each bottom flange 42 is substantially flush with the bottom face 20 of the electrical connector housing 12. The height of the cylindrical shank 36, as measured from the top 38 thereof to the plane defined by the lower surfaces 46 of the bottom flanges 42 is indicated by dimension "$b_1$" in FIG. 2 and is approximately equal to the overall thickness "b" of the electrical connector housing 12 in the vicinity of the mounting aperture 16. Thus, when the cylindrical shank 36 is advanced upwardly into the mounting aperture 16 of the electrical connector housing 12, the top end 38 thereof will be substantially flush with the top 18 of the electrical connector housing 12.

A plurality of deformable top tabs 48 extend upwardly beyond the top end 38 of the cylindrical shank 36. The top tabs 48 define a length greater than their circumferential width and greater than the thickness "g" of the metal from which the snap eyelet 10 is formed. This relatively great length of the top tabs 48 facilitates the outward deformation of the top tabs 48 in response to forces generated by appropriate application tooling. Thus, after complete upward insertion of the shank 36 into the mounting aperture 16 in the electrical connector housing 12, the top tabs 48 can be folded generally radially outwardly as shown in FIG. 6 to engage the top 18 of the housing 12 for securely retaining the snap eyelet 10 to the housing 12.

The snap eyelet 12 further includes three downwardly projecting deflectable locking beams 50 which project below the bottom 40 of the shank 36. The deflectable locking beams 50 are spaced approximately equally about the circumference of the cylindrical shank 36 and are disposed in alternating relationship with the bottom flanges 42, as shown most clearly in FIG. 3. Portions of the locking beams 50 remote from the shank 36 define ramping surfaces 52 which are angularly aligned to the longitudinal axis of the shank 36. The extreme bottom ends of the ramping surfaces 52 define a diameter "$f_1$" which is smaller than the diameter "f" of the mounting aperture 32 in the circuit board 14. However, areas on the ramping surfaces 52 closest to the mounting flange 36 define a maximum diameter "$f_2$" which exceeds the diameter "f" of the mounting aperture 32 in the circuit board 14.

The locking beams 50 are further provided with locking surfaces 54 which are adjacent to the ramped surfaces 52 but which are aligned in a generally opposite direction relative to the longitudinal axis of the shank 36. The longitudinal distance from the locking surface 54 to the bottom surface 46 of the bottom flanges 42 is identified by dimension "$e_1$" in FIG. 2, and is approximately equal to the thickness "e" of the circuit board 14. Thus, as explained further below, the circuit board 14 can be engaged between the lower surfaces 46 of the bottom flanges 42 and the locking surfaces 54 of the locking beams 50.

Each locking beam 50 further includes an engaging surface 56 adjacent the locking surface 54. Each engaging surface 56 is aligned approximately parallel to the longitudinal axis of the shank 36 in the undeflected condition of the locking beams 50. The engaging surfaces 56 of the respective locking beams 50 define a diameter "$f_3$" which is approximately equal to or slightly greater than the diameter "f" of the mounting aperture 32 in the circuit board 14. Thus, the engaging surfaces 56 of the locking beams 50 will be disposed in contact with interior surfaces of the circuit board 14 at the mounting aperture 32 therein.

The locking beams 50 each are further effectively defined by slots 58 extending into the cylindrical shank 36 of the snap eyelet 10. Portions of the beams 50 defined by the slots 58 function to achieve desired deflection characteristics for the respective beam 50 and to define a portion where the diameter is reduced from "$a_1$" for engaging the mounting aperture 16 in the connector 12 to diameter "$f_1$" for engaging the mounting aperture 32 in the circuit board 14.

The portions of each deflectable beam 50 that will engage the mounting aperture 32 in the circuit board 14 are chamfered as shown in FIGS. 3 and 4 to generally conform to the cylindrical configuration of the mounting aperture 32 in the circuit board 14. This configuration prevents sharp edges of a wide beam 50 from digging into the resinous material defining the circuit board 14. Instead, the longitudinal central portion of each deflectable beam 50, extending along the ramped surface 52, the locking surface 54 and the engaging surface 56 will contact portions of the circuit board 14 defining the mounting aperture 32 therein.

In use, as shown in FIG. 6 the electrical connector housing 12 will be provided with a pair of mounting apertures 16 generally disposed at opposed sides of the housing 12. Recesses 22 extend into the bottom surface 20 of the electrical connector housing 12. A portion of the shield 24 extends into each recess 22 such that the aperture 26 of the shield 24 is registered with the corresponding mounting aperture 16 in the electrical connector housing 12. A corresponding pair of snap eyelets are then urged through the apertures 26 and 16 in the respective shield 24 and housing 12. In particular, the top end 38 of the snap eyelet 10 is urged upwardly from the bottom 20 toward the top 18 of the electrical connector housing 12. In its fully seated condition, the bottom flanges 42 of the snap eyelet 10 will be engaged in the recess 22 such that the top surface 44 of each bottom flange 42 will abut the portion of the shield 24 in the recess 22 and such that the lower surface 46 of each bottom flange 42 will be aligned with the bottom 20 of the electrical connector housing 12. In this fully inserted condition, the cylindrical shank 36 will closely engage the cylindrical internal wall defining the mounting aperture 16 in the electrical connector housing 12. Additionally, in this fully seated condition, the top 38 of the cylindrical shank 36 will be substantially flush with the top 18 of the electrical connector housing 12. The top tabs 48, however, will extend upwardly beyond the top surface 18, and may subsequently be folded over into engagement with the top surface 18 by appropriate application tooling. As a result, the electrical connector housing 12 will effectively be securely engaged between the bottom flanges 42 and the top tabs 48 of the snap eyelet 10. It will be noted that this insertion and engagement of the snap eyelet 10 with the electrical connector housing 12 does not require any initial deflection of the beams 50. Thus, the beams 50 do not acquire a pre-set and do not undergo any permanent deformation prior to their use in mounting the connector housing 12 to the circuit board 14.

Use of the snap eyelet 10 proceeds by urging the electrical connector housing 12 onto the circuit board 14. The downward movement of the electrical connector housing 12 toward the circuit board 14 will cause the ramped surfaces 52 of the respective deflectable beams 50 to engage the portion of the circuit board 14 defining the periphery of the aperture 32. Forces generated on the ramped surfaces 52 will cause an inward deflection of the beams 50 to enable continued downward advancement of the electrical connector housing 12. After sufficient downward movement of the electrical connector housing 12 relative to the circuit board 14, the locking surfaces 54 will clear the bottom face 30 of the circuit board 14, thereby enabling the beams 50 to resiliently return toward an undeflected condition. In this undeflected condition as depicted in FIG. 6, the locking surfaces 54 of the beams 50 will engage the lower surface 30 of the circuit board 14, while the engagement surfaces 56 contact the interior periphery of the mounting hole 32 in the circuit board 14. Thus, the circuit board 14 will be securely engaged between the locking surfaces 54 and the bottom flanges 42 of the snap eyelet 10. The chamfered cross-sectional configuration of the beams 50 approximately conforms to the arcuate cross-sectional shape of the mounting aperture 32 in the circuit board 14 to ensure that at least a longitudinal central portion of each beam 50 engages the circuit board 14 at the aperture 32 therein. The electrical connection of the locking surfaces 54 to the ground circuit 34 may be permanently completed by soldering as depicted in FIG. 6.

As noted above, mounting apertures in circuit boards are not always accurately dimensioned or disposed. The construction of the snap eyelet 10 envisions and accommodates such variations, particularly in view of the fact that snap eyelets are used in pairs. In this regard, the angled configuration of the locking surfaces 54 ensures a tight gripping of the circuit board 14 between the locking surfaces 54 and the lower surfaces 46 of the bottom flanges 42. Additionally, the diameter defined by the engaging surfaces 56 in their undeflected condition is selected to ensure contact with the cylindrical periphery of the mounting aperture 32 of the circuit board 14 for an anticipated range of dimensional variations. Furthermore, the provision of three beams 50 ensures that at least two of the beams 50 will contact the circuit board 14 and the ground circuit 34 on each of two snap eyelets 10 despite any imprecision in the locations of two mounting apertures 32 relative to one another While the invention has been described with respect to a preferred embodiment, it is apparent that various changes can be made without departing from the scope of the invention as defined by the appended claims.

I claim:

1. A snap eyelet for mounting an electrical connector housing to a circuit board and for electrically connecting a conductive shield of the housing to a ground circuit on the circuit board, said housing and said circuit board each being provided with mounting apertures therein, said housing and said circuit board each further including opposed top and bottom surfaces defining relative thicknesses of the respective housing and circuit board, said snap eyelet comprising: a shank dimensioned for slidable insertion into the mounting aperture of the housing, said shank having opposed top and bottom ends defining a length therebetween substantially equal to the thickness of the housing adjacent the mounting aperture therein, at least one bottom flange extending rigidly from the bottom end of the shank for engaging the bottom surface of the connector housing, at least one deformable top tab extending generally axially from the top end of the shank and being deflectable into engagement with the top surface of the electrical connector housing, three deflectable board engaging beams substantially equally spaced about the bottom of the shank extending downwardly from the shank, the board engaging beams being configured and disposed for snap engagement with the circuit board adjacent the mounting aperture therein.

2. A snap eyelet as in claim 1 wherein the mounting aperture in the circuit board is generally cylindrical, and wherein the shank of the snap eyelet is generally cylindrical and defines an outer diameter dimensioned for slidable engagement with the mounting aperture in the connector housing.

3. A snap eyelet as in claim 1 wherein the bottom flange is aligned substantially orthogonal to the longitudinal axis of the shank.

4. A snap eyelet as in claim 1 wherein the connector housing includes a recess in the bottom surface substantially surrounding the mounting aperture therein, the bottom flange being dimensioned to be inserted into the recess and to be substantially flush with the bottom surface of the connector housing upon complete insertion of the shank into the mounting aperture of the connector housing.

5. A snap eyelet as in claim 1 wherein each deflectable beam includes an outer surface having opposed longitudinal sides chamfered to generally conform to the shape of the mounting aperture in the circuit board.

6. A snap eyelet as in claim 1 wherein each said deflectable beam includes a locking surface angularly aligned to the longitudinal direction of the deflectable beam and spaced from the bottom flange by an axial distance approximately equal to the thickness of the circuit board.

7. A snap eyelet as in claim 1 wherein said top tab defines an axial length greater than its transverse width.

8. A snap eyelet as in claim 7 comprising three top tabs substantially equal spaced around the top end of the shank.

9. A snap eyelet as in claim 8 comprising three bottom flanges substantially equally spaced around the bottom end of the shank.

10. A snap eyelet as in claim 9 wherein each said bottom flange is aligned with a respective space between the top tabs for achieving efficient balancing of engagement forces on the connector housing.

11. A snap eyelet for mounting an electrical connector housing to a circuit board, said snap eyelet being stamped and formed from a unitary piece of resilient conductive material and comprising: a generally cylindrical shank having opposed top and bottom ends, a plurality of bottom flanges extending rigidly generally orthogonally from the bottom end of the shank for engaging a bottom surface of the connector housing, a plurality of top tabs extending from the top end of the shank and being deformable into engagement with a top surface of the electrical connector housing, a plurality of resiliently deflectable board engaging beams extending downwardly from the bottom end of the shank, each beam including a downwardly facing ramped surface for generating deflection of the beam during mounting of the electrical connector housing to the circuit board and a locking surface for engaging regions of the circuit board opposite the connector housing upon complete mounting of the connector housing to the circuit board.

12. A snap eye let as in claim 11 wherein each board engaging beam includes an outwardly facing surface chamfered to conform generally to a cylindrical cross-sectional shape of a mounting aperture in the circuit board.

13. A shielded electrical connector assembly for mounting to a circuit board and for electrically contacting a ground circuit on the circuit board, the circuit board including a top face, a bottom face and at least one mounting aperture extending therebetween, a ground circuit being disposed on the bottom face in proximity to the mounting aperture, the electrical connector assembly comprising:

an electrical connector having a molded non-conductive housing having a bottom surface for mounting on the top surface of the circuit board and an opposed top surface, at least one mounting aperture extending through the electrical connector housing from the top surface thereof to the bottom surface for general registration with the mounting aperture of the circuit board, a shield mounted to a selected portion of the housing and extending into proximity with the mounting aperture therethrough;

a snap eyelet stamped and formed from a unitary strip of flat metallic material and comprising a generally cylindrical shank slideably disposed in the mounting aperture of the housing, said cylindrical shank being characterized by opposed top and bottom ends, a plurality of substantially rigid bottom flanges extending from the bottom end of the shank and electrically contacting the portion of the shield of the connector in proximity to the mounting aperture thereof, a plurality of top tabs extending from the top end of the shank and deformed into tight engagement with the top surface of the connector housing, and a plurality of deflectable board engaging beams passing longitudinally through the mounting aperture of the circuit board and including a locking surface securely engaging portions of the ground circuit disposed on the bottom face of the circuit board and in proximity to the mounting aperture therethrough.

* * * * *